United States Patent [19]

Sawhney et al.

[11] Patent Number: 4,961,306

[45] Date of Patent: Oct. 9, 1990

[54] SYSTEM FOR PRODUCING STAPLE-WRAPPED CORE YARN

[75] Inventors: A. Paul S. Sawhney, Metairie; Craig L. Folk, New Orleans; Kearny Q. Robert, New Orleans; Linda B. Kimmel, New Orleans, all of La.

[73] Assignee: The United States of America as represented by the Secretary of Agriculture, Washington, D.C.

[21] Appl. No.: 469,120

[22] Filed: Jan. 24, 1990

[51] Int. Cl.[5] ..... D02G 3/36; D02G 3/38; D01H 13/04

[52] U.S. Cl. ..... 57/12; 57/6; 57/210; 57/315; 57/352

[58] Field of Search ..... 57/3, 6, 7, 12, 13, 57/15–18, 315, 210, 352

[56] References Cited

U.S. PATENT DOCUMENTS

| | | | |
|---|---|---|---|
| 2,859,583 | 11/1958 | Parker | 57/12 |
| 3,255,579 | 6/1966 | Price | 57/315 X |
| 3,370,410 | 2/1968 | McKew et al. | 57/12 |
| 3,778,988 | 12/1973 | White et al. | 57/12 |
| 4,368,611 | 1/1983 | Mainka et al. | 57/6 |
| 4,519,195 | 5/1985 | Belin et al. | 57/6 X |

*Primary Examiner*—John Petrakes
*Attorney, Agent, or Firm*—M. Howard Silverstein; John D. Fado

[57] ABSTRACT

A core/wrap yarn forming system comprising two or more channels extending outwardly from the nip of the front draft rolls of a ring-spinning system; wherein each channel's entrance is closely adjacent to the nip; wherein the entrances are spaced apart from one another; wherein the channels merge with one another at the exit from the device; wherein the first channel is essentially straight throughout its length, and is perpendicular to the nip; wherein each of the other channels is curved to guide the strand therein in a convex pathway with respect to the first channel, and converge inward to the end of the first channel. The core is supplied through the straight channel, while one or more wrapping strands pass through the curved channel or channels, and wrap around the core where all the channels merge. The wrapped yarn then is passed to an ordinary ring traveler and wind-up spindle of a ring-spinning assembly. In this manner, unwrapped roving is converted to core/wrap yarn in a single draft stage in a continuous process on a ring-spinning frame.

29 Claims, 2 Drawing Sheets

FIG. 1
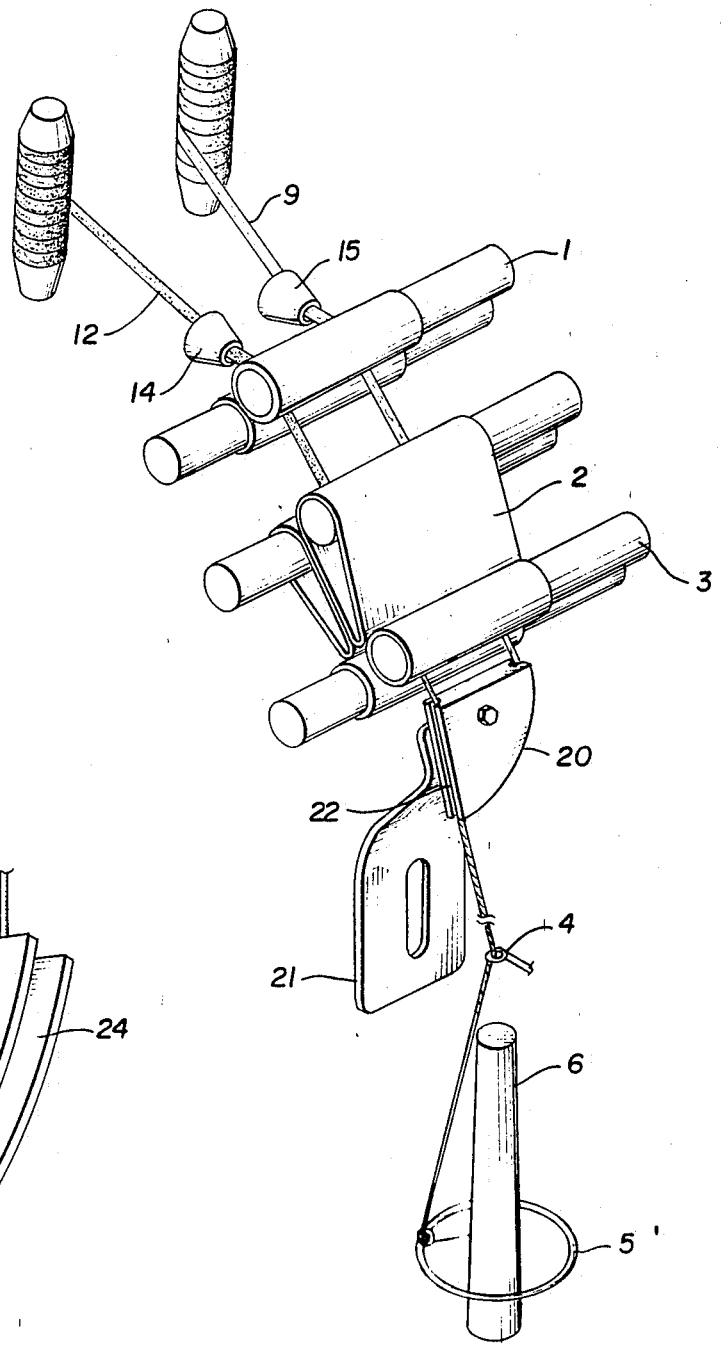
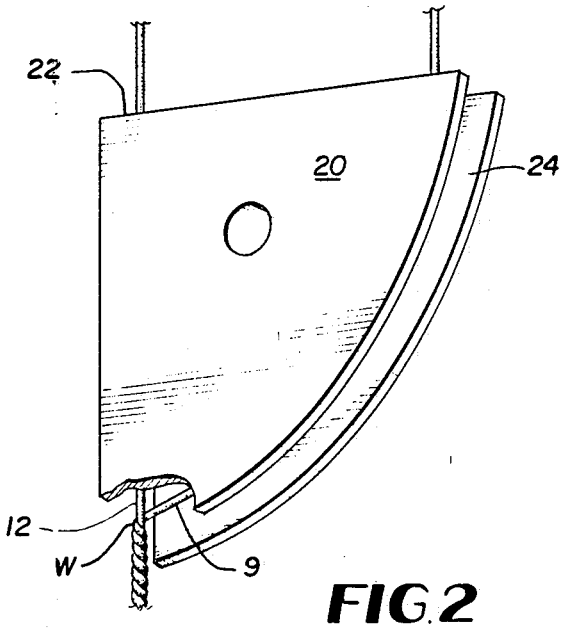
FIG. 2

SYSTEM FOR PRODUCING STAPLE-WRAPPED CORE YARN

FIELD

This invention relates to production of textile yarns.

PRIOR ART

It is known that core/wrap or wrapped core yarns may be produced by wrapping a fibrous sheath around a continuous-filament core. Alternatively, a continuous filament may be wrapped around a staple fiber core. Still further, both the core and wrapping or sheathing may consist of staple fibrous materials, or both may be continuous filament materials, or some combination thereof. To date, in the production of ring-spun core/-wrap yarn with staple fibrous materials, the wrapping step has been carried out prior to ring spinning, i.e., during the formation of roving from sliver, thereby producing a core/wrap roving, which subsequently must be spun into yarn in a ring spinning step; or during the drawing process, thereby producing a concentrically cored sliver, which subsequently must be roved into roving and spun into yarn in a ring spinning step. To date, no practical system has been developed to directly produce core/wrap yarn in a ring-spinning frame from a plurality of unwrapped roving strands.

The following definitions apply to several terms that appear in the specification and claims:

Carding - the use of a carding machine to align, clean and straighten fibers, and to remove very short fibers, as well as fine trash, to produce sliver.

Drawing - the making parallel and straightening of sliver fibers to improve the uniformity of linear density, usually accomplished in 1, 2, or 3 passages through drawing equipment known as a draw frame or drafting frame. In each passage through a draw frame, several sliver strands are combined into a single sliver strand.

Drafting - the process whereby a fiber bundle such as a sliver or roving is extended in length in order to reduce the linear density of the bundle and to increase the parallelization of the fibers. Various forms of drafting are employed in carding, drawing, roving and ring-spinning.

Sliver - the product produced by carding or drawing, i.e., a very coarse strand of fibers having essentially no twist.

Roving process - conversion of sliver by drafting into a thinner strand called a roving in which a small amount of twist (normally 2 turns per inch) is imparted to the strand. This step is performed only in conjunction with subsequent ring spinning. No other type of spinning presently requires roving prior to spinning.

Ring-spinning process - As used herein, an operation for converting roving into yarn by drafting a roving and imparting twist through use of a ring and a moving traveler on a ring-spinning frame. A small percentage of ring-spinning machines do not require prior formation of roving, but instead convert sliver directly into yarn except that the sliver is passed through additional drafting apparatus on the ring frame immediately prior to passage through the ordinary draft rolls/aprons associated with ring spinning.

SUMMARY

Broadly the device comprises first and second elongated channels extending outwardly from the nip of the draft rolls; wherein each channel's entrance is closely adjacent to the nip; wherein the entrances are spaced apart from one another; wherein the channels merge with one another at the exit from the device; wherein the first channel is essentially straight throughout its length, and is perpendicular to the nip; wherein the second channel is curved so that it guides any strand therein toward the merging point in a convex pathway relative to the first channel. The core strand is supplied through the straight channel, while the wrapping strand passes through the curved channel, and wraps around the core where the two channels merge.

The channels are substantially enclosed, but one side of each channel is open to allow large imperfections, slubs, or bits of foreign matter to flow along with the fibers without clogging the channel, and to facilitate start-up or piecing of the yarn.

The wrapped yarn then is passed to an ordinary ring traveler and wind-up spindle of a ring-spinning assembly. In this manner, conventional (unwrapped) roving is converted to core/wrap yarn in a continuous process.

An object of the present invention is to provide proper orientation and positive guidance of the flow of fibers to the wrapping point.

Another object is to permit slight slippage of the wrap fibers in the wrap-fiber channel so that the core strand may be almost completely covered.

A further object of the present invention is to produce a new core/wrap yarn having the following advantages and distinctions over previous yarn products:

The core is covered at least 90% compared to much lesser percentage of previous core/wrap products.

The core fibers are oriented along the length of the yarn and are positioned in the middle of the cross-section.

Due to unique interlacing of the cover fibers with the core fibers, the yarn sheath does not strip from the core at all. Furthermore, the strip resistance is equally good in both directions along the yarn.

The staple-core/cotton-wrap yarn produced with a high tenacity staple fiber is significantly stronger than an equivalent 100% cotton yarn or an equivalent, regular intimate-blend yarn of the same blend proportions.

The device is capable of producing relatively fine yarns (e.g., yarns of up to 40/1 cotton count or finer).

Both the core as well as cover fibers contribute to the mechanical properties of the yarn produced by the present system; and mechanical properties, such as tear strength, tensile strength and abrasion resistance, of the fabrics produced from such yarns exhibit significant improvements.

The staple-core-spun yarns of the present invention are economical compared to existing filament-core yarns, mainly because of the lower cost of the staple fibers, compared to filament yarns.

Inferior quality cotton, wool, manmade fiber, or any other fiber can be used in the core, and the premium fiber can be utilized in the cover to produce a premium-looking product. The core may be a continuous filament material such as polyester, or the core and wrap may be staple fibers that are different from one another composition-wise and/or quality-wise.

Many types of novelty yarns and fabrics, such as crepe-like, denim-like, and differential dye effects, can be produced by the spinning technique of the present invention.

The staple-core yarns are highly useful for producing textile products where high strength and cotton surface are both desirable and/or critical, such as strong, easy-to-care-for and comfortable apparel of predominantly cotton; certain military fabrics, such as tentage, chambray shirting, work uniforms, strong sewing threads with heat-insulating cotton cover, and strong pill-resistant fabrics.

Other objects and advantages of the present invention will be obvious from the following detailed description, in conjunction with the drawings in which:

FIG. 1 is a perspective view of the overall system of the present invention.

FIG. 2 is a perspective, partial cut-away, view of wrapping means 20 of FIG. 1.

Figure 3:
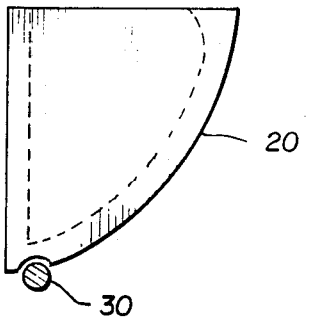
FIG. 3 is a preferred modification of FIG. 2.
Figure 3A:
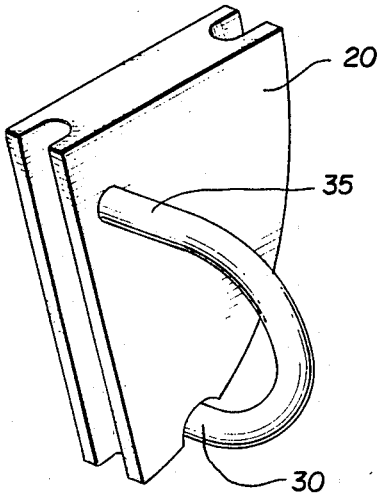

FIG. 3*a* is an alternative embodiment of FIG. 3.

Figure 4:
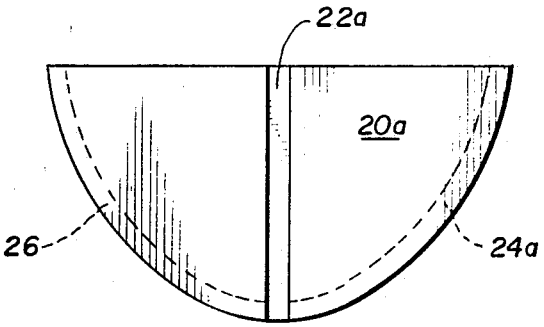
Figure 4A:
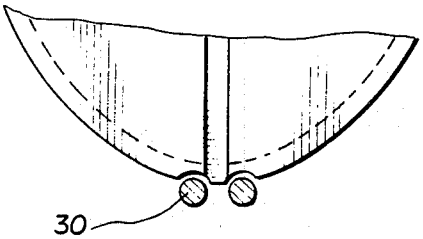

FIGS. 4 and 4*a* are alternative embodiments of FIG. 2.

DETAILED DESCRIPTION

Components of ordinary ring spinning equipment may be employed in the practice of the present invention. These are illustrated in FIG. 1 as rear or back draft rollers 1, drafting aprons 2, front draft rollers 3, pigtail guide 4, ring 5 and yarn bobbin 6. Hereinafter, this combination of elements is referred to as a single spinning system.

In addition, there are two bobbins upstream of rear draft rollers 1. One of these bobbins supplies wrap roving 9 such as cotton roving to rear rollers 1, while the other bobbin supplies core roving 12 such as polyester roving thereto.

Starting materials for the practice of the present invention, such as cotton and polyester rovings, may be prepared in a conventional manner.

Two spaced-apart, conventional roving condensers 14, 15, or equivalent, are disposed between the bobbins and rear rollers 1 in order to maintain a space between rovings.

Immediately downstream and closely adjacent to the nip of front rollers 3 is the new structure 20 of the present invention for enveloping the wrap fibers around the core strand. Member 20 is bolted through a mounting hole in the middle of its face or otherwise secured to a bracket 21, or equivalent, which in turn is secured to the frame of the spinning equipment.

Referring to the view of member 20 in FIG. 2, reference numeral 22 designates a first substantially enclosed channel which brings the core strand 12 to the wrapping point W. Numeral 24 designates a second channel which brings the wrap strand 9 to the wrapping point. The purpose of the two channels is to maintain the stability of the strands in the zone between the front roller nip and wrapping point so that twisting or torquing of the strands is substantially reduced in this zone. In addition, the device permits the necessary slippage of the sheathing or wrapping material, to produce a slight so-called sheath attachment draft for providing the extra wrap length to completely cover the core.

Member 20 preferably is placed as close to the front roller nip as possible. This closeness essentially depends upon the thickness of member 20 which thickness essentially depends upon the cross-sectional dimensions of channels 22 and 24. Generally, member 20 may be placed about 1/32 to ⅜" from the front roller nip. In addition, it is positioned at such an angle to the front roller nip so that the core channel is aligned with the front roller nip and the pigtail guide 4. In general, the angle between the longitudinal axis of member 20 and the spindle axis (spindle 6), when viewed along the side thereof, is about 15 to 20 degrees.

The spacing between the core and wrap strands at the front roller nip is the same as the spacing between these two strands at the entrance to wrapping member 20; and member 20 is aligned with the front roller nip so that the pathways of the core and wrap strands from the nip to member 20 are perpendicular to the nip. This spacing depends upon the fiber lengths being processed, and, consequently, on the size of the spinning equipment (i.e., short-, mid-, or long-staple spinning equipment). For a conventional cotton (short-staple) spinning system, the space between the wrap and core strands, or between the entrances of channels 22 and 24, may be about ⅜" to ⅝". For long staple fibers such as wool, this dimension may vary from about ½" to 1¼".

The length of the core channel 22 plus the length of the gap between the nip and the origin of channel 22 should total about 75%–85% of the staple length of the core material (staple length is the length of the longest few % of the fibers). At the same time, member 20 should be as close to the nip of the front rollers as possible, typically about 1/32" to ⅜" as noted above. In this manner, the fibrous strand between the front roller nip and yarn wrapping point will be strong enough to withstand the yarn spinning tension in view of the fact that the overall distance from the nip to the wrapping point is less than the staple length of the core fibers, and thus no drafting (internal slipping) of the core occurs.

Thus, in the fabrication of member 20, the length of channel 22 depends upon (a) the staple length of the core fiber and (b) how close member 20 is to be placed to the front roller nip. If the nip-to-member distance is to be very close, then the length of channel 22 will absorb most of the requirement that the distance from the nip to the wrapping point be about 75%–85% of the staple length of the core fiber. On the other hand, if the nature of the core fiber is such that member 20 is to be placed relatively further from the front roller nip, then channel 22 will absorb a smaller percentage of the required distance; and, under such circumstances, channel 22 may be about 50% to 75% of the staple length of the core fiber.

The length of the curved channel 24 should be about 10%–25% longer than the staple length of the wrap strand fibers. For 1-inch staple cotton, the channel length typically would be about 1–¼"; for a 3-inch long wool fiber, this distance typically would be about 3–⅜". Preferably, the curve of channel 24 is such that the curve extends all the way from the channel entrance to the wrapping point as illustrated in FIG. 2. In addition, the curvature of channel 24 for short-staple wrapper fibers (such as cotton) preferably is about the same as that of the circumference of a circle having a radius equal to the length of straight channel 22. At the point of intersection between channels 22 and 24, the angle generally is about 80 to 90 degrees.

Each channel may be "v" shaped, rectangular, oval, circular, or any concave shape. The channel's width preferably should be slightly wider than the diameter of the strand being supplied thereto from the front roller nip, i.e., about 1½ to 2 times the strand diameter. In more absolute terms, the width of each channel may be about 1/16" more than the diameter of the strand being supplied thereto, in the case of medium-fine to fine yarns; about ⅛" more than strand diameter, in the case of medium-fine yarn counts; and from about ⅛" to ¼" more than strand diameter in the case of coarse yarns.

The depth of each groove or channel is about the same as its width, preferably about 75–150% of the groove width, depending upon groove shape. A flat (rectangular) groove may have a depth less than the width, while a "v" shaped groove may have a maximum depth greater than its maximum width.

For ease of machining and soundness of structure, in the case of plastic structures, the thickness of member 20 should be at least twice the width of the wider groover (channel 22 or 24).

Plexiglas is a suitable material of construction for member 20. While the channels are illustrated as being in the edge or rim of member 20, such channels may be provided in one or more faces of the member 20.

FIG. 3 illustrates a most preferred addition to member 20. More specifically, a transverse guide 30 is located adjacent to channel 24, immediately prior to the point where channel 24 intersects with channel 22. As can be seen in the figure, the position of the guide is such that part of its curved surface barely projects into the channel opening of channel 24 so that the wrapping strand therein comes in contact with the curved guide surface immediately prior to wrapping around the core strand. A portion of the fibers in the wrapping strand change direction as they pass over the guide. The main function of the guide 30 is to prevent the barber-poling caused or induced by inter-strand twisting or plying and the flow of large imperfections in the materials, especially in the drafted cotton strand.

Referring now to FIG. 3*a*, therein is illustrated a preferred arrangement for connecting a transverse guide 30 to the overall apparatus via an elongated rod. More specifically, the guide may be part of a U-shaped member, one leg of which comprises guide 30, while the other leg, 35, snuggly fits into a hole in member 20. In this manner, the guide may be manually moved to various positions by turning leg 35 in the snug hole of member 20, although the guide ordinarily does not need adjustment.

Referring now to FIG. 4 and 4*a*, therein is shown a modification of the apparatus wherein two wrapping strands are supplied to the wrapping point. In this embodiment, a third wrapper channel 26, together with wrap channel 24*a* and core channel 22*a*, is provided in member 20*a* to supply an additional wrap strand to the wrapping point. It is preferable to employ a three-slot condenser in this embodiment immediately in front of back rollers 1 (FIG. 1) or immediately behind front rollers 3 following aprons 2 (FIG. 1), if necessary, when processing relatively fine yarns of cotton and polyester staple. FIG. 4*a* shows that a guide 30 can be used at each wrapper channel 24*a* and 26.

The following describes a small scale, laboratory-type, method which was employed to fabricate a wrapping structure suitable for the purposes of the present invention:

A groove, 3.2 mm wide, 2.4 mm deep, was cut in the outside periphery of a plexiglass disc, 5.1 cm diameter, 0.63 cm thickness. The disc was then quartered. A groove, 1.6 mm wide, 2.4 mm, deep was cut along one of the straight sides of one of the segments of the quartered disc. A 2.4 mm diameter guide was installed thereafter on the segment in the manner of FIG. 3*a*.

In addition to employing staple fibrous materials in the practice of the present invention, continuous filament such as continuous polyester filament may be used. In that case, the filament core strand is fed behind the front-roller nip, so that no drafting of the filament core takes place. The filament may also be used in combination with staple fibers for the core.

Various other options may be employed in the practice of the present invention. For example, an adjustable guide/ condenser may be disposed between front rollers and member 20 when the member is spaced farther away from the front roller nip than usual, such as when processing relatively coarse, long-staple fibers (wool, nylon, Kevlar, polyester, and so forth), thereby providing support for the strands between the nip and member 20. The condenser may be a simple, slotted-plate-type made of either thin metal or plastic.

What is claimed is:

1. A method for forming core/wrap yarn comprising a. supplying a core of continuous filament or fibrous material from a draft roll nip to a wrapping point through a first channel, said channel being essentially straight and perpendicular to said nip;

b. supplying a first wrap strand from said nip through a second channel which merges with said first channel at said wrapping point to form core/wrap yarn, wherein said wrap strand is spaced from said core at said nip, wherein said second channel is curved to guide said wrap strand to said wrapping point in a convex pathway with respect to said first channel; and c. passing said core/wrap yarn to a wind-up spindle.

2. The method of claim 1 further including passing said wrap strand in contact with a guide immediately prior to wrapping said wrap strand around said core.

3. The method of claim 2 wherein both said core and wrap contain staple fibers, but are of different materials and/or quality.

4. The method of claim 2 further comprising passing said core/wrap yarn from said guide directly to a pigtail guide on said wind-up spindle.

5. The method of claim 4 wherein both said core and wrap contain staple fibers, but are of different materials and/or quality.

6. The method of claim 4 wherein said draft roll nip is the front draft roll nip of a ring spinning system.

7. The method of claim 6 wherein both said core and wrap contain staple fibers, but are of different materials and/or quality.

8. The method of claim 2 wherein said draft roll nip is the front draft roll nip of a ring spinning system.

9. The method of claim 8 wherein both said core and wrap contain staple fibers, but are of different materials and/or quality.

10. The method of claim 1 further comprising supplying a second wrap strand from said nip through a third channel which merges with said first and second channels at said wrapping point, wherein said second wrap strand is spaced from said core at said nip on the opposite side of said core from said first wrap strand, wherein said third channel guides said wrap strand to said wrapping point in a convex pathway relative to said first channel.

11. The method of claim 10 further including passing said second wrap strand in contact with a guide immediately prior to wrapping said second wrap strand around said core.

12. The method of claim 11 wherein both said core and wrap contain staple fibers, but are of different materials and or quality.

13. The method of claim 11 wherein said draft roll nip is the front draft roll nip of a ring spinning system.

14. Apparatus for forming core/wrap yarn comprising a. a pair of draft rolls having a nip therebetween;

b. a first channel adjacent said nip, extending from said nip to a wrapping point, to supply a core to said wrapping point, said channel being essentially straight and perpendicular to said nip; and c. a second channel adjacent said nip, extending from said nip to merge with said first channel at said wrapping point to supply a first wrapping strand to said wrapping point to form core/wrap yarn at said wrapping point, wherein said wrapping strand is spaced from said core at said nip, wherein said second channel is curved to guide said wrapping strand to said wrapping point in a convex pathway relative to said first channel.

15. The apparatus of claim 14 further including a transverse guide adjacent to said second channel immediately upstream from said wrapping point, which comes in contact with part of said wrapping strand immediately prior to wrapping around said core strand.

16. The apparatus of claim 15 wherein said draft rolls are the front rolls of a ring spinning apparatus, and further including a ring spindle downstream from said wrapping point to receive said core/wrap yarn thereon.

17. The apparatus of claim 16 wherein said first and second channels are part of a single member.

18. The apparatus of claim 16 further including a third enclosed channel extending from said nip from a point spaced from said first and second channels, said third channel extending to said wrapping point to supply a second wrapping strand to said wrapping point, said third channel being curved to guide said second wrapping strand to said wrapping point in a convex pathway relative to said first channel, but from the opposite side of said second channel.

19. The apparatus of claim 18 wherein said first, second and third channels are part of a single member.

20. The apparatus of claim 15 wherein said first and second channels are part of a single member.

21. The apparatus of claim 14 wherein said draft rolls are the front rolls of a ring spinning apparatus, and further including a ring spindle downstream from said wrapping point to receive said core/wrap yarn thereon.

22. The apparatus of claim 21 wherein said first and second channels are part of a single member.

23. The apparatus of claim 14 wherein said first and second channels are part of a single member.

24. The apparatus of claim 14 further including a third substantially enclosed channel extending from said nip from a point spaced from said first and second channels, said third channel extending to said wrapping point to supply a second wrapping strand to said wrapping point, wherein said third channel is curved to guide said second wrapping strand to said wrapping point along a convex pathway relative to said first channel, but from the opposite side as said second channel.

25. The apparatus of claim 24 further including transverse guides adjacent to said second and third channels immediately upstream from said wrapping point, each of which guides comes in contact with part of said first or second wrapping strand, respectively, immediately prior to wrapping around said core.

26. The apparatus of claim 25 wherein said first, second, and third channels are part of a single member.

27. The apparatus of claim 24 wherein said draft rolls are the front rolls of a ring spinning apparatus, and further including a ring spindle downstream from said wrapping point to receive said core/wrap thereon.

28. The apparatus of claim 27 wherein said first, second, and third channels are part of a single member.

29. The apparatus of claim 24 wherein said first, second and third channels are part of a single member.

* * * * *